US007946098B1

(12) United States Patent
Wild et al.

(10) Patent No.: US 7,946,098 B1
(45) **Date of Patent: *May 24, 2011**

(54) APPARATUS FOR APPLYING DRINKING STRAWS

(75) Inventors: Hans-Peter Wild, Zug (CH); Eberhard Kraft, Neckarbischofsheim (DE)

(73) Assignee: INDAG Gesellschaft für Industriebedarf mbH & Co. Betriebs KG, Eppelheim (DE)

( * ) Notice: Subject to any disclaimer, the term of this patent is extended or adjusted under 35 U.S.C. 154(b) by 17 days.

This patent is subject to a terminal disclaimer.

(21) Appl. No.: 09/690,409

(22) Filed: Oct. 17, 2000

(30) Foreign Application Priority Data

Oct. 28, 1999 (DE) ..... 199 52 008

(51) Int. Cl.
*B65B 61/00* (2006.01)

(52) U.S. Cl. ..... 53/410; 53/133.1; 156/358

(58) Field of Classification Search ..... 156/358; 53/133.1, 133.2, 410
See application file for complete search history.

(56) References Cited

U.S. PATENT DOCUMENTS

| | | | | |
|---|---|---|---|---|
| 4,384,915 | A * | 5/1983 | Utsumi | 156/499 |
| 4,572,758 | A * | 2/1986 | Wild | 156/256 |
| 4,574,558 | A | 3/1986 | Utsumi | |
| 4,584,046 | A * | 4/1986 | Geyssel | 156/358 |
| 4,584,819 | A | 4/1986 | Hakansson | |
| 4,669,699 | A * | 6/1987 | Kaneko | 248/652 |
| 4,707,965 | A * | 11/1987 | Becker | 53/410 |
| 5,979,142 | A | 11/1999 | Kraft et al. | |
| 6,681,547 | B1 * | 1/2004 | Wild et al. | 53/410 |

FOREIGN PATENT DOCUMENTS

| | | |
|---|---|---|
| DE | 197 45 855 | 4/1999 |
| EP | 0 085 895 | 8/1983 |
| EP | 909710 | 4/1999 |
| JP | 60-129309 | 8/1985 |

* cited by examiner

*Primary Examiner* — Thanh K Truong
(74) *Attorney, Agent, or Firm* — Stroock & Stroock & Lavan LLP

(57) ABSTRACT

Apparatus for applying a drinking straw on a receiving surface of a stand up bag which can be supplied on a conveying surface to a transfer device for drinking straws. To increase the conveying speed of said apparatus, the transfer means is arranged such that the drinking straw while being handed over encloses an acute angle with the conveying surface.

5 Claims, 2 Drawing Sheets

APPARATUS FOR APPLYING DRINKING STRAWS

FIELD OF THE INVENTION

The present invention relates to an apparatus for applying drinking straws of the type explained in the preamble to bags.

BACKGROUND OF THE INVENTION

Such an apparatus is known from DE 197 45 855. The known apparatus uses a transfer device in the form of a rotary drum on the periphery of which a drinking straw strip is supplied that consists of still cohering packages of individually packed drinking straws. Furthermore, the drinking straw strip contains adhesive points already applied before, which are covered with a cover strip for the time being. Shortly before being applied to the stand up bag the cover strip is removed from the adhesive points and the drinking straw packages are isolated, preferably cut, so that a respective drinking straw can then be adhesively applied by the roller, supported by a press-on finger, to each bag. The known apparatus is designed for applying drinking straws to stand up bags conveyed in an upright manner on a conveyor belt, the transfer means enclosing a right angle with the conveyor surface.

EP 149 076 B1 describes a further apparatus for applying drinking straws which is designed for applying drinking straws to lying bags. The transfer device for the drinking straws extends here in parallel with the conveying surface on which the bags are located.

Stand up bags, however, have no parallel side surfaces but consist of two rectangular film pieces which are secured along their longitudinal edges one on top of the other and which in the area of their lower transverse edges have an inserted or molded-on stand up bag and in the area of their upper transverse edges are indirectly welded one on top of the other, resulting in a substantially triangular longitudinal section. Both in the case of an upright transportation and a lying transportation the attachment surfaces on the bag are thus not in parallel with the conveying surface and thus also not in parallel with the transfer device for the drinking straws. Normally, this is not objectionable, as becomes also apparent from the well-functioning devices of the prior art.

SUMMARY OF THE INVENTION

The invention, however, has found out that the handling speeds in the vertical or parallel arrangement of the transfer device relative to the conveying surface can still be optimized.

It is thus the object of the present invention to improve an apparatus for applying drinking straws to stand up bags in such a manner that their conveying speed is increased.

Thanks to the design according to the invention the movement path of the drinking straws can be shortened and the drinking straws can be moved in a parallel movement without any angular change from the transfer device to the bag. Although the increase in speed achieved thereby is within the range of fractions of seconds, even such a small increase in speed effects an economic result in a mass product such as a stand up bag and with the high throughputs achieved by modern bag filling and packaging systems.

BRIEF DESCRIPTION OF THE DRAWINGS

An embodiment of the present invention shall now be explained with reference to the drawings, in which.

DETAILED DESCRIPTION OF THE PREFERRED EMBODIMENT

Figure 1:
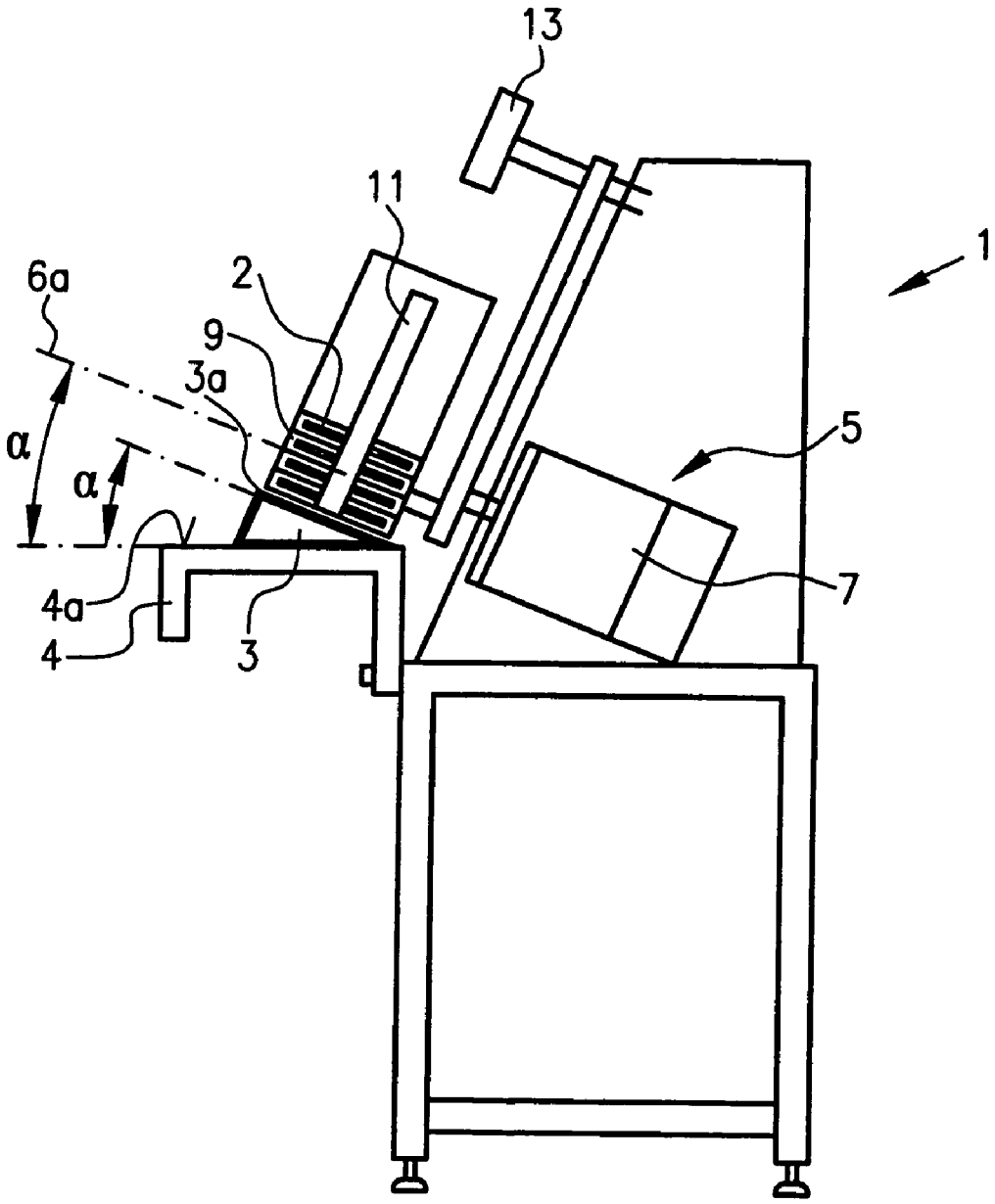
FIG. 1 is a schematic side view of an apparatus according to the invention.
Figure 2:
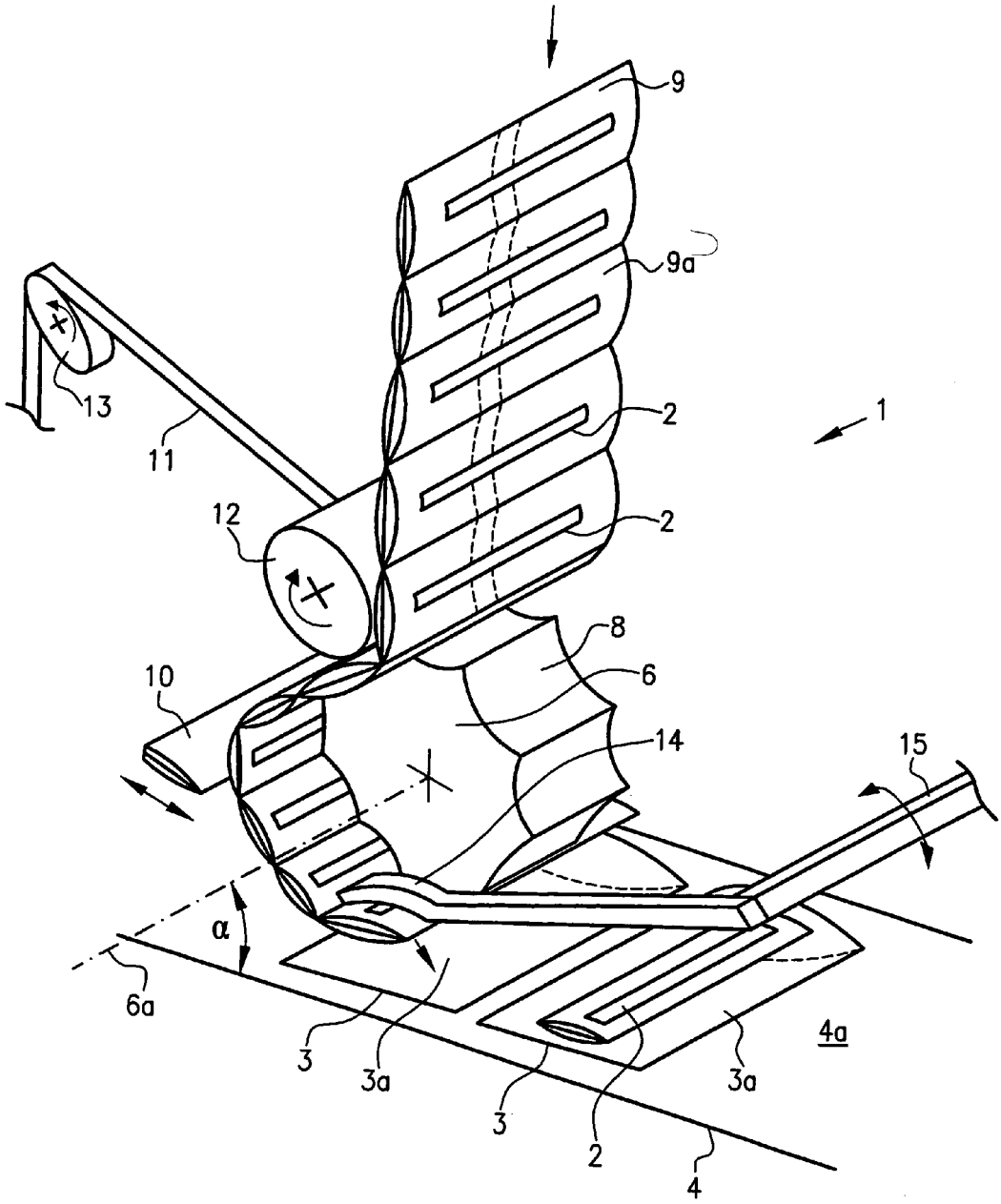
FIG. 2 is a schematic view showing details of the apparatus according to FIG. 1.

FIGS. 1 and 2 shows an apparatus 1 for applying drinking straws 2 to a receiving surface 3*a* of stand up bags 3. The stand up bags are transported in a lying position on a horizontal conveyor belt 4 in a direction perpendicular to the illustration in FIG. 1, the upper side of the horizontal conveyor 4 forming a substantially horizontal conveyor surface 4*a*.

The apparatus 1 contains a transfer means 5 which comprises a transfer drum 6 which is rotatably driven by a motor 7 about a rotational axis 6*a*. The transfer drum 6 is provided on its periphery with recesses 8 which can each receive one of the drinking straws 2. The drinking straws 2 are individually sealed in packages 9*a* which before reaching a cutting device 10 are still cohering in a continuous drinking straw strip 9. The packages 9*a* are already provided with adhesive points which are protectively covered by a cover strip 11. The drinking straw strip 9 is supplied by supply devices (not shown), it is pressed by a press-on roll 12 against the transfer drum 6 while the cover strip 11 is removed via a roll 13 which is driven in synchronism with the transfer drum 6 by the motor 7. The transfer drum 6 has assigned thereto a transfer finger 14 which is movable around a pivot arm 15 in the direction of the double-headed arrow and presses the packages 9*a*, which have been isolated by the cutting device 10, together with the drinking straw 2 onto the receiving surface 3*a* of the bags which have been supplied in a lying position on the conveyor 4, whereby the adhesive points can adhere.

The rotational axis 6*a* of the transfer drum 6 is inclined by an angle $\alpha$ relative to the conveying surface 4*a*. The angle $\alpha$ is smaller than 90° and preferably corresponds to the angle $\alpha$ under which the receiving surface 3*a* is inclined relative to the conveying surface 4*a* when the stand up bag 3 is transported in a lying position on the conveying surface 4*a*. Furthermore, said angle $\alpha$ corresponds to the angle enclosed by the receiving surface with the opposite surface of the bag 3 which rests on the conveying surface 4*a*. Since stand up bags which are filled with beverages cannot exactly keep their shape because most of the time they consist of plastic films or laminated aluminum foils, angle $\alpha$ can also be determined as a mean value.

During operation the stand up bags 3 are supplied in a continuous row on the conveyor 4 to the transfer device 5, the transfer drum 6 is rotated in synchronism with the conveyor speed of the conveyor 4 about the axis 6*a*, the drinking straw strip 9 is fed continuously, the cover strip 11 is continuously removed, the individual packages 9*a* are cyclically isolated by the cutting device from the drinking straw strip 9 and cyclically pressed by the press-on finger 14 onto the receiving surface 3*a* of the stand up bags. For retaining the already isolated drinking straw packages 9*a* the transfer drum 6 can be designed as a suction drum. Two adjacent transfer drums can also be used that have a distance from each other which enables the finger 14 to operate between the drums so that an even better support of the isolated drinking straw packages 9 is achieved.

On account of the inclined position of the rotational axis 6*a* relative to the conveyor surface 4*a*, the drinking straw package 9*a* impinges on said receiving surface 3*a* exactly in parallel with said surface 3*a*, i.e. it need not carry out a displacing and tilting movement as has so far been necessary. The conveying movement can thereby be further accelerated.

In a modification of the described and illustrated embodiment, the apparatus according to the invention can also be used for applying drinking straws to stand up bags conveyed in an upright position; in this case, however, the angle of inclination must be adjusted to the larger acute angle which is enclosed by the receiving surface relative to the conveying surface and which is approximately 90° minus half the angle of enclosure between the receiving surface and the opposite surface on the stand up bag.

In a further modification of the described and illustrated embodiment, it is also possible to use other transfer means which are capable of applying drinking straws very rapidly. Furthermore, it is not absolutely necessary that all of the components of the devices are inclined. It is enough when the drinking straw has such an angle while being handed over.

We claim:

1. A method of attaching a straw package to a foil bag having a triangular cross section, the method comprising:

providing a plurality of foil bags having a base and a first side wall comprising a first film and a second side wall comprising a second film, the first wall being connected to the second wall at an acute angle therewith, the first film including a plurality of first side edges overlapping and adhered to a plurality of second side edges of the second film, the first film having a first top edge connected to a second top edge of the second film, the base being connected to a bottom edge of the first film and to a bottom edge of a second film; wherein the foil bags are constructed to stand with the base located toward the bottom of the foil bag;

providing a plurality of straw packages having an adhesive thereon and a cover strip covering the adhesive;

positioning each of the foil bags on a conveyor belt such that the foil bag lies on the conveyor belt on the first side wall, so that the second side wall is at an acute angle with the conveyor belt;

removing the cover strip from the plurality of straw packages and exposing the adhesive;

providing a lever having a depressing arm and a pivoting arm;

rotating the pivoting arm of the lever to displace the depressing arm downward toward the conveyor belt to apply one straw package onto the second side wall at an acute angle to the conveyor belt such that the adhesive of the straw package contacts the second side wall.

2. The method of claim 1, further comprising applying an adhesive on the straw package prior to applying the straw package onto the second side wall.

3. A method of attaching a straw package to a bag having a first rectangular film piece connected to a second rectangular film piece along three edges thereof, the foil bag also having a base connected to a bottom edge of the first rectangular film piece and to a bottom edge of the second rectangular film piece such that the foil bag has a triangular cross section, the method comprising:

providing a plurality of bags having a base, a first side wall and a second side wall, wherein the first side wall and the second side wall share at least two edges, and the bags are constructed to stand on the base;

positioning a bag on a conveyor belt such that the bag lays on the conveyor belt on the first side wall, and the second side wall is at an acute angle with the conveyor belt;

providing a plurality of straw packages from above the conveyor belt, the straw packages having an adhesive thereon and a cover strip covering the adhesive;

providing a lever having a depressing arm and a pivoting arm;

rotating the pivoting arm of the lever to displace the depressing arm downward toward the conveyor belt to apply a straw package to the second side wall at an acute angle with the conveyor belt and substantially parallel to the second side wall such that the adhesive contacts the second side wall.

4. A method of attaching a straw package to a foil bag having a first rectangular film piece connected to a second rectangular film piece along three edges thereof, the foil bag also having a base connected to a bottom edge of the first rectangular film piece and to a bottom edge of the second rectangular film piece such that the foil bag has a triangular cross section, the method comprising:

providing a plurality of foil bags having a base and a first side wall comprising a first film and a second side wall comprising a second film, the first wall being connected to the second wall at an acute angle therewith, the first film including a plurality of first side edges overlapping and adhered to a plurality of second side edges of the second film, the first film having a first top edge connected to a second top edge of the second film, the base being connected to a bottom edge of the first film and to a bottom edge of a second film; wherein the bags are constructed to stand with the base located toward the bottom of the bag;

positioning a foil bag on the conveyor belt such that the foil bag lays on the conveyor belt on a first side wall, so that the second side wall is at an acute angle with the conveyor belt;

providing a transfer drum above the conveyor belt, the transfer drum being rotatable about an axis substantially parallel to the second side wall;

providing a plurality of straw packages on the periphery of the transfer drum, a straw package being positioned substantially parallel to the second side wall, the straw package having an adhesive thereon covered by a cover strip;

providing a lever having a depressing arm and a pivoting arm;

removing the cover strip and exposing the adhesive; and rotating the pivoting arm of the lever to displace the depressing arm downward toward the conveyor belt to apply the straw package onto the second side wall such that the adhesive of the straw package contacts the second side wall while maintaining the straw package substantially parallel to the second side wall.

5. A system for applying straw packages onto foil bags having a triangular cross section, the system comprising:

a plurality of bags having a first side having a first film having a rectangular shape and a second side having a second film having a rectangular shape, wherein the first film includes a plurality of first side edges, a first top edge and a first bottom edge, the second film includes a plurality of second side edges, a second top edge and a second bottom edge, and wherein the first film overlaps and is adhered to the second film proximate the first side edges, wherein the first top edge is connected to the second top edge;

the plurality of bags further having a base connected to the first film and the second film proximate the first bottom edge and the second bottom edge, wherein the bags are constructed and arranged to stand on the base;

the plurality of bags having a cross section having a triangular shape defined by the first side, the second side and the base;

a conveyor belt constructed and arranged to convey the plurality of bags with the first side facing up and the second side contacting the conveyor belt;

a plurality of straw packages connected to one another, the straw packages having an adhesive thereon, the adhesive being covered by a removable cover strip;

a transfer assembly positioned above the conveyor belt, the transfer assembly having a straw retaining member constructed and arranged to receive and retain the straw packages substantially parallel to the first side of the bags, a disconnecting member to disconnect one straw package from the plurality of straw packages, and a straw applying member having a depressing arm and a pivoting arm, wherein rotating the pivoting arm of the lever displaces the depressing arm downward toward the conveyor belt to displace a straw package away from the retaining member and to apply the straw package onto one of the plurality of bags on the conveyor belt such that the straw package is attached to the bag via the adhesive.

* * * * *